US007281585B2

(12) United States Patent
Zheng

(10) Patent No.: US 7,281,585 B2
(45) Date of Patent: Oct. 16, 2007

(54) OFFSHORE COILED TUBING HEAVE COMPENSATION CONTROL SYSTEM

(75) Inventor: Shunfeng Zheng, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 18 days.

(21) Appl. No.: 11/354,744

(22) Filed: Feb. 15, 2006

(65) Prior Publication Data

US 2007/0187108 A1 Aug. 16, 2007

(51) Int. Cl.
*E21B 29/12* (2006.01)

(52) U.S. Cl. ..... 166/355; 166/66; 166/77.2

(58) Field of Classification Search ..... 166/355, 166/354, 353, 350–352, 66, 85.1, 77.1, 77.2
See application file for complete search history.

(56) References Cited

U.S. PATENT DOCUMENTS 3,421,581 A * 1/1969 Geijn ..... 166/355
4,421,173 A * 12/1983 Beakley et al. ..... 166/336
5,767,671 A * 6/1998 McCoy et al. ..... 324/209
5,775,417 A * 7/1998 Council ..... 166/77.3
6,000,480 A * 12/1999 Eik ..... 175/8
6,116,345 A * 9/2000 Fontana et al. ..... 166/343
6,192,983 B1 * 2/2001 Neuroth et al. ..... 166/250.15
6,276,454 B1 * 8/2001 Fontana et al. ..... 166/343
6,386,290 B1 * 5/2002 Headworth ..... 166/346
6,415,877 B1 * 7/2002 Fincher et al. ..... 175/5
6,554,075 B2 4/2003 Fikes et al.
6,648,081 B2 * 11/2003 Fincher et al. ..... 175/25
6,688,814 B2 2/2004 Wetch et al.
6,691,775 B2 * 2/2004 Headworth ..... 166/77.2
6,834,724 B2 * 12/2004 Headworth ..... 166/384
6,923,273 B2 * 8/2005 Terry et al. ..... 175/45
6,968,905 B2 * 11/2005 Adnan et al. ..... 166/384
7,063,159 B2 * 6/2006 Patton et al. ..... 166/355
2004/0151549 A1 8/2004 Roodenburg et al.
2005/0211430 A1 9/2005 Patton et al.
2006/0065402 A9 * 3/2006 Fontana et al. ..... 166/358

FOREIGN PATENT DOCUMENTS

GB 2141470 * 12/1984
GB 2334048 8/1999
GB 2343466 5/2000

* cited by examiner

*Primary Examiner*—Thomas A Beach
(74) *Attorney, Agent, or Firm*—Rodney Warfford; Dave Cate; Robin Nava

(57) ABSTRACT

An offshore oil well assembly is provided that includes a floating vessel and a coiled tubing injector supported on the floating vessel. A coiled tubing string is movable by the injector into and out of a wellbore. The assembly also includes at least one measurement device which, either directly or indirectly, measures a heave induced acceleration of the injector; and a control system which receives a signal from the measurement device indicating the heave induced acceleration of the injector, and transmits a command signal which causes a counteracting acceleration to be applied to the coiled tubing, wherein the counteracting acceleration is opposite to the heave induced acceleration experienced by the injector.

20 Claims, 3 Drawing Sheets

OFFSHORE COILED TUBING HEAVE COMPENSATION CONTROL SYSTEM

FIELD OF THE INVENTION

The present invention relates generally to a compensation system for an offshore coiled tubing assembly, and more particularly to a heave compensation control system which measures a heave induced acceleration on an injector of the coiled tubing assembly and applies a counteracting acceleration in response thereto.

BACKGROUND

With the increased production of offshore oil wells, coiled tubing operations are more and more frequently performed on floating vessels or boats. Not surprisingly, such operations encounter many problems that do not occur on land wells. One such example is the movement of on deck equipment caused by waves. Specifically, the heave effect caused by waves can have serious adverse effects on the mechanical integrity of coiled tubing when run from a floating vessel.

This effect is particularly severe in offshore deep well applications, where the acceleration due to a heave of the floating vessel can induce significant tensile loading on the coiled tubing. In situations where a coiled tubing string is working close to its combined stress limit, the effect of heave could cause the coiled tubing string to work beyond its safe working limit, potentially resulting in catastrophic failure. Failure of such nature is typically costly due to the offshore environment of the operation, the loss of production time, and/or the replacement/repair of damaged equipment, for example.

Accordingly, a need exists for a coiled tubing assembly having a control system capable of mitigating the effect of heave for offshore coiled tubing operations performed on a floating vessel.

SUMMARY

In one embodiment, the present invention is an offshore oil well assembly that includes a floating vessel and a coiled tubing injector supported on the floating vessel. A coiled tubing string is movable by the injector into and out of a wellbore. The assembly also includes at least one measurement device which, either directly or indirectly, measures a heave induced acceleration of the injector; and a control system which receives a signal from the measurement device indicating the heave induced acceleration of the injector, and transmits a command signal which causes a counteracting acceleration to be applied to the coiled tubing, wherein the counteracting acceleration is opposite to the heave induced acceleration experienced by the injector.

In another embodiment, the above assembly further includes at least one adjuster operable to move the injector. In this embodiment, the control system receives a signal from the measurement device indicating the heave induced acceleration of the injector; and transmits a first command signal to the injector, causing a drive system of the injector to impart a first component of a counteracting acceleration on the coiled tubing. In this embodiment, the control system also transmits a second command signal to the at least one adjuster, causing the at least one adjuster to move the injector to impart a second component of the counteracting acceleration on the coiled tubing.

In yet another embodiment, the present invention is a method of compensating for heave motions on a coiled tubing assembly supported by a floating vessel that includes disposing the coiled tubing assembly on the floating vessel; and coupling a coiled tubing string to an injector of the coiled tubing assembly, wherein the injector is operable to move the coiled tubing string into and out of a wellbore. The method also includes measuring, either directly or indirectly, a heave induced acceleration of the injector; and providing a control system which receives a signal indicating the heave induced acceleration of the injector, and transmits a command signal which causes a counteracting acceleration to be applied to the coiled tubing, wherein the counteracting acceleration is opposite to the heave induced acceleration experienced by the injector.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

As shown in FIGS. 1-4, embodiments of the present invention are directed to a coiled tubing assembly having a control system for mitigating the effect of heave on a coiled tubing string during a coiled tubing operation performed on a floating vessel. Note that for the purpose of this disclosure a floating vessel is defined as a boat, a floater, a light vessel, or any other appropriate surface floating platform that lacks an adequate positioning system to counter the heave effect of waves.

Figure 1:
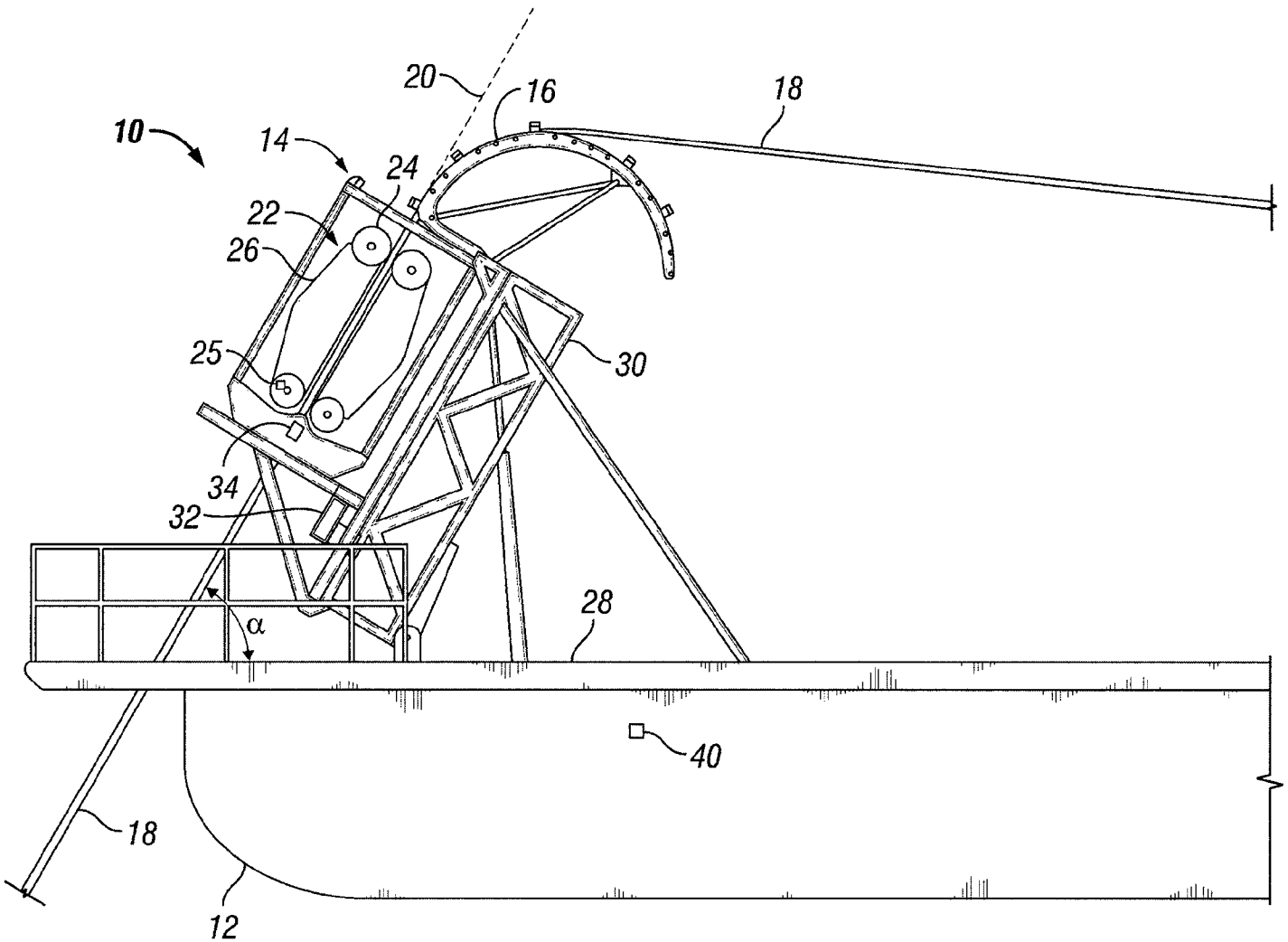
FIG. 1 is a side cross-sectional view of a coiled tubing assembly having a heave compensation system according to one embodiment of the present invention for use on a floating vessel.

FIG. 1 shows a coiled tubing assembly 10, according to one embodiment of the present invention, disposed on a floating vessel 12. As shown, the coiled tubing assembly 10 includes an injector head 14, also referred to simply as an injector 14. Extending from the injector 14 is a gooseneck 16. The gooseneck 16 guides a coiled tubing string 18 from a spool of coiled tubing (not shown) to the injector 14. The injector 14 is operable to move the coiled tubing string 18 in either direction along its longitudinal axis 20. As such, the injector 14 may inject or retrieve portions of the coiled tubing 18 into or out of a wellbore (not shown) as desired, either during or after a coiled tubing operation has been completed.

As shown, in one embodiment the injector 14 includes a drive system 22 for controlling the above described movement of the coiled tubing 18 into or out of the wellbore. In the depicted embodiment, the drive system 22 includes a pair of conveyors, such as a pair of drive chains 26. In such an embodiment, the coiled tubing string 18 is disposed between and movable by the drive chains 26. Each drive chain 26 includes one or more rollers, or drive sprockets 24. The drive chains 26 are laterally movable toward or away from the coiled tubing string 18 to create more or less frictional engagement with the coiled tubing string 18.

When the drive chains 26 are engaged with the coiled tubing string 18, a rotation of the drive sprockets 24 in a first direction causes the drive chains 26 to inject additional portions of the coiled tubing string 18 into the wellbore; and rotation of the drive sprockets 24 in a second direction, opposite from the first direction, causes the drive chains 26 to retrieve portions of the coiled tubing string 18 from the wellbore.

In one embodiment, a speed sensor (represented schematically in FIG. 1 by reference number 25) is mounted on or near the injector drive system 22 to determine the speed of movement of the coiled tubing 18 by the injector drive system 22. Also, as described in detail below, in one embodiment a control system 36 (such as that shown in FIG. 2) controls both the speed and direction of the movement of the coiled tubing 18 by the injector drive system 22.

It should be noted that although a particular injector drive system 22 is described above, in alternative embodiments any appropriate injector drive system capable of injecting and retrieving coiled tubing 18 into and out of a wellbore may be incorporated into the coiled tubing assembly 10 of the present invention.

Supported by a deck or floor 28 of the floating vessel 12 is an injector support structure 30. As shown, the injector 14 is mounted to the support structure 30. In one embodiment, the support structure 30 includes devices for adjusting the injector 14 in a number of different directions, and/or angular orientations. However, in one embodiment, once the injector 14 is adjusted to a desired position, the injector 14 is set in place so that it is not moveable relative to the support structure 30, and hence not movable relative to the floating vessel 12 during a coiled tubing operation. In alternative embodiments, the injector support structure 30 may include any appropriate device for supporting the injector 14, such as a crane.

In the embodiment of FIG. 1, one or more measurement devices (represented schematically in FIG. 1 by reference number 34.) are disposed on or near the injector 14. The measurement device(s) 34 are used to detect an acceleration of the injector 14 caused by heave motions on the floating vessel 12. As such, the measurement device(s) 34 may include any device(s) capable of measuring acceleration, speed, and/or position of the injector 14. For example, the measurement device 34 may include an accelerometer, a speed sensor, a strain gauge, and/or a load cell, among other appropriate devices. Such devices may be used to either directly or indirectly measure the acceleration of the injector 14 caused by heave motions on the floating vessel 12.

Also, since in this embodiment the injector 14 is non-movably mounted to the injector support structure 30, which in turn is non-movably mounted to the floor 28 of the floating vessel 12, any acceleration experienced by the injector support structure 30 and/or the floating vessel 12 is also experienced by the injector 14. As such, in alternative embodiments, the measurement device(s) 34 may be disposed on or near the injector support structure 30, or on or near the floating vessel 12.

In one embodiment, the measurement device(s) 34 are positioned such that they measure the acceleration of the injector 14 in the direction along the coiled tubing 18 in the drive chains 26 of the drive system 22, which in most cases coincides with the longitudinal axis 20 of the injector 14. For example, in instances where the injector 14 is positioned vertically with respect to the floating vessel 12, such that the coiled tubing 18 exits the injector 14 in a vertical direction, the measurement device(s) 34 are positioned to measure the acceleration of the injector 14 in the vertical direction.

On the other hand, in instances where the injector 14 is positioned such that the coiled tubing 18 exits the injector 14 at another angle $\alpha$ with respect to the floating vessel floor 28, the measurement device(s) 34 are positioned to measure the acceleration of the injector 14 along that particular exit angle $\alpha$. For example, in the depicted embodiment the coiled tubing 18 exits the injector 14 at an exit angle $\alpha$ of approximately 45 degrees from the floating vessel floor 28, and hence the measurement device(s) 34 are positioned to measure the acceleration of the injector 14 in the same approximately 45 degree direction.

In the depicted embodiment, the longitudinal axis 20 of the injector 14, the portion of the coiled tubing 18 within the drive chains 26 of the drive system 22, and the portion of the coiled tubing 18 exiting the injector 14 are all along the same line (i.e., they are all disposed at the same angle $\alpha$ with respect to the floating vessel floor 28.) In most instances this will be the case. However, in instances where this is not the case, the measurement device(s) 34 may be positioned to measure the acceleration of the injector 14 either: along the longitudinal axis 20 of the injector 14, along the portion of the coiled tubing 18 within the drive chains 26 of the drive system 22, or along the portion of the coiled tubing 18 exiting the injector 14, among other appropriate frames of reference.

Additionally or in the alternative, the measurement device(s) 34 may be positioned to measure the acceleration of the injector 14 in more than one direction. For example, the measurement device(s) 34 may be positioned to measure any or all of the vertical component, the horizontal component, and the lateral component of the acceleration of the injector 14 (such as the x, y and z components of the acceleration of the injector 14. As described in detail below, in one embodiment, in response to the measured acceleration on the injector 14, the injector drive system 22 produces a counteracting acceleration on the coiled tubing 18.

Figure 2:
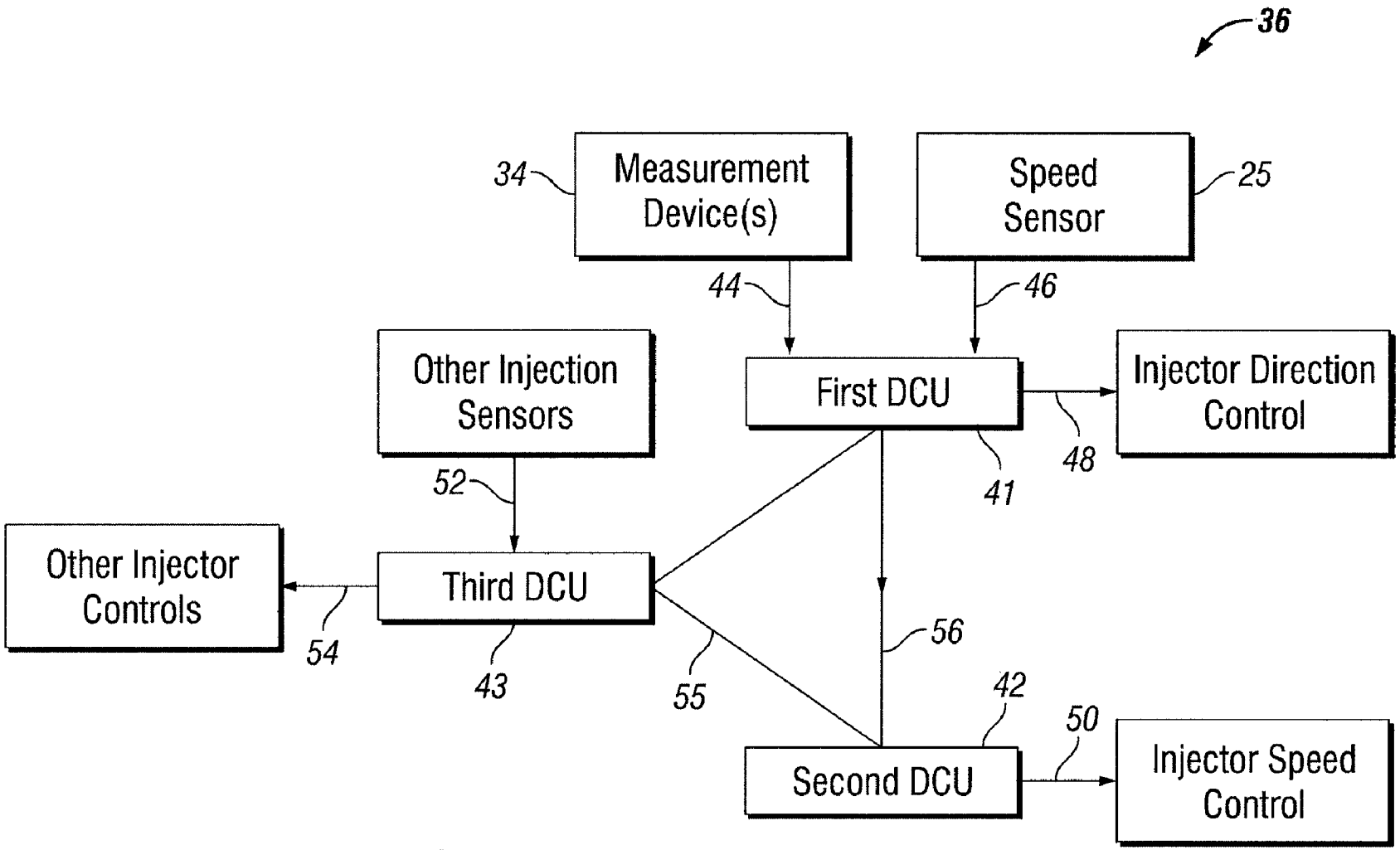
FIG. 2 shows a diagram of a control system for use with the coiled tubing assembly of FIG. 1.

In one embodiment, a distributed control system 36, such as that shown in FIG. 2, is used to control and monitor the operation of the injector 14, and more specifically the injector drive system 22. As shown, the control system 36 includes one or more distributed control units (DCUs) 41, 42 and 43. The DCU(s) 41-43 interact with various sensors and/or control valves to monitor and control the operation of the coiled tubing injector 14 and its corresponding drive system 22.

In one embodiment, each DCU 41-43 has its own computing power, and can act upon sensor parameters to affect a change in various operational parameters of the injector 14 without the need for operator intervention. When there are more than one DCU 41-43 in the control system 36, the DCUs 41-43 communicate with each other through various field control network devices, such as CAN, or ProfiBus, among other appropriate devices.

In one embodiment, a first DCU 41 is operable to receive signals 44 from the measurement device (s) 34, and signals 46 from the injector speed sensor 25 (the sensor which measures the speed of movement of the coiled tubing 18 caused by the injector drive system 22.) In this embodiment, the first DCU 41 also is operable to transmit command signals 48 to control the direction of the movement of the coiled tubing 18 into or out of the wellbore by the injector drive system 22.

A second DCU 42 is operable to transmit command signals 50 to control the speed of the movement of the coiled tubing 18 by the injector drive system 22. A third DCU 43 is operable to receive signals 52 from other injector sensors and transmit other command signals 54 to control other injector 14 operational parameters if desired.

In this embodiment, when the first DCU 41 receives a signal 44 from the measurement device(s) 34 indicating an acceleration a(t) experienced by the injector 14 as a result of a heave motion on the floating vessel 12, the first DCU 41 sends out a corresponding signal 56 through the CAN bus 55 to the second DCU 42, which receives the acceleration signal 56 and sends out control commands 48 and 50 to modify the speed and/or direction of movement that the injector drive system 22 imparts on the coiled tubing 18 to create a counteracting acceleration (−a(t)) on the coiled tubing 18, which may be equal and opposite to the acceleration a(t) experienced by the injector 14 due to heave motions. Consequently, the net acceleration experienced by the coiled tubing 18 is minimized.

In alternative embodiments, any of the signals 44, 46, and 52 may be received by any of the DCUs 41-43, and any of the control commands 48, 50 and 54 may be transmitted by any of the DCUs 41-43. In addition, in one embodiment the first, second and third DCUs 41-43 can be combined into a single DCU capable of receiving signals 44, 46, and 52 from the measurement device(s) 34, the speed sensor 25, and other injector sensors, respectively; and sending speed 50, direction 48 and other 54 command signals to the injector 14 to control the movement of the coiled tubing 18 that is created by the injector drive system 22. This will improve system response time and improve the efficiency of the compensated effort.

For a coiled tubing control system that uses speed as a control parameter, when an acceleration a(t) is experienced by the injector 14, the new speed target ($V_m$) for the injector drive system 22 to impart on the coiled tubing 18 can be calculated as:

$$V_m = V_0 - \int_t a(t)dt$$

where $V_0$ is the initial target speed that the injector drive system 22 imparts on the coiled tubing 18 at the time that the acceleration on the injector 14 is experienced.

As described above, the measurement device(s) 34 may be positioned to measure the acceleration of the injector 14 in any or all of the acceleration components in the vertical, horizontal and lateral directions, and/or in the direction along the longitudinal axis 20 of the injector 14. The injector drive system 22, however, only applies a counteracting acceleration in the direction of its applied force to the coiled tubing 18, which is usually along the longitudinal axis 20 of the injector 14.

As such, in order to create a counteracting acceleration in more than one direction, in an alternative embodiment the coiled tubing assembly 10 may include one or more injector adjustors (represented schematically in FIG. 1 by reference number 32.) In such an embodiment, once the injector 14 is adjusted to a desired position, the support structure 30 maintains the ability to adjust the position of the injector 14 even while a coiled tubing operation is being performed. As such, in this embodiment, the adjustor 32 moves the entire injector 14 (including the coiled tubing 18 held thereby) to create a counteracting acceleration on the coiled tubing 18.

By appropriately positioning the adjustors 32, any desired number of the acceleration components on the injector 14 may be directly counteracted by one or more adjustors 32. For example, one or more adjustors 32 may be used to directly compensate for injector acceleration components in the vertical, horizontal and lateral directions, and/or the acceleration component in the direction along the longitudinal axis 20 of the injector 14. Each adjustor 32 may include any appropriate device for causing a movement of the injector 14 in one or more desired directions. For example, the adjustors may include one or more hydraulic cylinders, and/or one or more rack and pinion systems.

Figure 3:
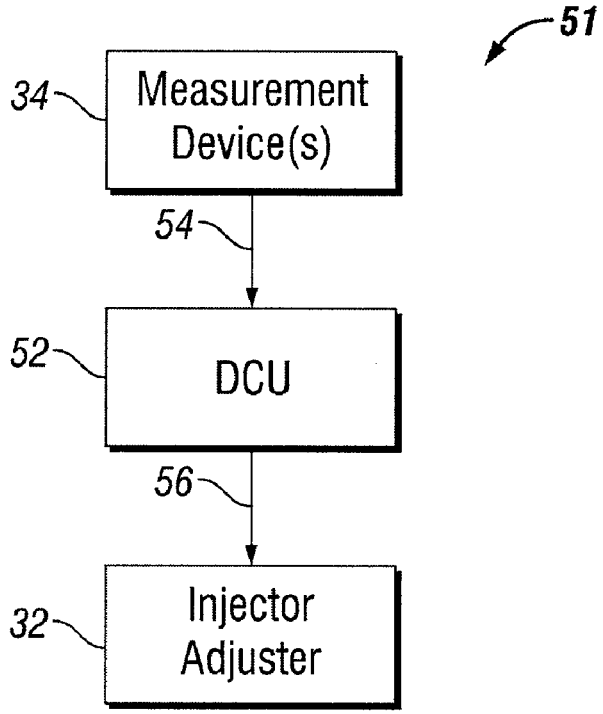
FIG. 3 shows a diagram of an alternative control system for use with the coiled tubing assembly of FIG. 1.

In one embodiment, a distributed control system 51, such as that shown in FIG. 3, is used to control and monitor the operation of the injector 14. As shown, the control system 51 includes a DCU 52 that receives a signal 54 from the measurement device(s) 34 indicating an acceleration a(t) of the injector 14 resulting from a heave motion on the floating vessel 12. Upon receiving the acceleration signal 54, the DCU 52 sends out a control command 56 to the injector adjustor 32 causing the adjustor to apply an acceleration (−a(t)) on the injector which is equal and opposite from the acceleration a(t) experienced by the injector 14 due to heave motions. Consequently, the net acceleration experienced by the coiled tubing 18 is minimized.

Figure 4:
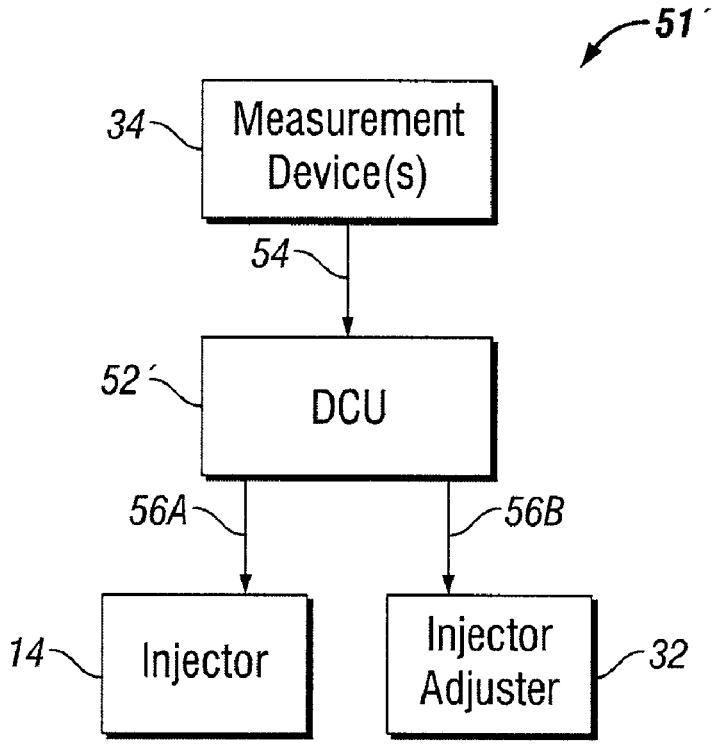
FIG. 4 shows a diagram of yet another alternative control system for use with the coiled tubing assembly of FIG. 1.

In one embodiment, such as that shown in FIG. 4, a counteracting acceleration on the coiled tubing 18 may be performed by using both the injector drive system 22, and the one or more adjustors 32. In such a system 51', the control system 51' includes a DCU 52' that receives a signal 54 from the measurement device(s) 34, and transmits a first command signal 56A to the injector 14, causing the injector drive system 22 to impart a first component of a counteracting acceleration on the coiled tubing 18. In this system 51', the DCU 52' also transmits a second command signal 56B to the adjuster(s) 32, causing the adjuster(s) 32 to move the injector 14 to impart a second component of the counteracting acceleration on the coiled tubing 18.

Additionally, one or more measurement sensors (represented schematically in FIG. 1 by reference number 40) may be mounted on or near the floating vessel 12, or even in the water itself, in order to detect and/or measure the acceleration of upcoming waves. Such a wave acceleration detection/measurement is useful in predicting an impending movement of the coiled tubing 18 by the waves. This prediction allows for an improved response time in producing a counteracting acceleration on the coiled tubing 18. However, it should be noted that the wave acceleration detection/measurement is not necessarily used in aiding in the measurement of the acceleration on the injector 14 itself.

The preceding description has been presented with reference to presently preferred embodiments of the invention. Persons skilled in the art and technology to which this invention pertains will appreciate that alterations and changes in the described structures and methods of operation can be practiced without meaningfully departing from the principle and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. An offshore oil well assembly comprising:

a floating vessel;

a coiled tubing injector supported on the floating vessel;

a coiled tubing string movable by the injector into and out of a wellbore;

at least one measurement device which measures, one of directly and indirectly, a heave induced acceleration of the injector; and a control system which receives a signal from the measurement device indicating the heave induced acceleration of the injector, and transmits a command signal which causes a counteracting acceleration to be applied to the coiled tubing, wherein the counteracting acceleration is opposite to the heave induced acceleration experienced by the injector.

2. The assembly of claim 1, wherein the at least one measurement device measures the heave induced acceleration of the injector in a direction along a longitudinal axis of the injector.

3. The assembly of claim 1, wherein the at least one measurement device measures the heave induced acceleration along a portion of the coiled tubing that is within a drive system of the injector.

4. The assembly of claim 1, wherein the control system transmits said command signal to the injector causing the injector to impart said counteracting acceleration on the coiled tubing.

5. The assembly of claim 4, wherein the injector comprises a drive system which causes a relative movement between the injector and the coiled tubing string to impart said counteracting acceleration on the coiled tubing.

6. The assembly of claim 1, further comprising at least one adjuster, and wherein the control system transmits said command signal to the at least one adjuster, causing the at least one adjuster to move the injector to impart said counteracting acceleration on the coiled tubing.

7. The assembly of claim 6, wherein the at least one measurement device measures the heave induced acceleration of the injector in a first direction and in a second direction, which is perpendicular to the first direction.

8. The assembly of claim 7, wherein the counteracting acceleration on the coiled tubing is equal to and oppositely directed from the heave induced acceleration experienced by the injector.

9. The assembly of claim 8, wherein the at least one adjuster is operable to move the injector in the first direction and in the second direction.

10. An offshore oil well assembly comprising:

a floating vessel;

a coiled tubing injector supported on the floating vessel and comprising a drive system;

a coiled tubing string movable by the drive system of the injector into and out of a wellbore;

at least one measurement device which measures a heave induced acceleration of the injector;

at least one adjuster operable to move the injector; and a control system which receives a signal from the measurement device indicating the heave induced acceleration of the injector; wherein the control system transmits a first command signal to the injector, causing the injector drive system to impart a first component of a counteracting acceleration on the coiled tubing, and wherein the control system transmits a second command signal to the at least one adjuster, causing the at least one adjuster to move the injector to impart a second component of the counteracting acceleration on the coiled tubing.

11. The assembly of claim 10, wherein the at least one measurement device measures the heave induced acceleration of the injector in a first direction and in a second direction, which is perpendicular to the first direction.

12. The assembly of claim 11, wherein the first and second components of the counteracting acceleration combine to form a counteracting acceleration on the coiled tubing that is equal to and oppositely directed from the heave induced acceleration experienced by the injector.

13. The assembly of claim 10, wherein the at least one measurement device measures the heave induced acceleration of the injector in a first direction; in a second direction, which is perpendicular to the first direction; and in a third direction, which is along a longitudinal axis of the injector.

14. A method of compensating for heave motions on a coiled tubing assembly supported by a floating vessel comprising:

disposing the coiled tubing assembly on the floating vessel;

coupling a coiled tubing string to an injector of the coiled tubing assembly, wherein the injector is operable to move the coiled tubing string into and out of a wellbore;

measuring, one of directly and indirectly, a heave induced acceleration of the injector;

providing a control system which receives a signal indicating the heave induced acceleration of the injector, and transmits a command signal which causes a counteracting acceleration to be applied to the coiled tubing, wherein the counteracting acceleration is opposite to the heave induced acceleration experienced by the injector.

15. The method of claim 14, wherein the control system transmits said command signal to the injector causing a drive system of the injector to cause a relative movement between the injector and the coiled tubing string to impart said counteracting acceleration on the coiled tubing.

16. The method of claim 15, further comprising providing at least one measurement device, which measures the heave induced acceleration of the injector in a direction along a longitudinal axis of the injector, and sends said signal to the control system indicating the heave induced acceleration of the injector.

17. The method of claim 15, further comprising providing an adjuster, and wherein the control system transmits a command signal to the adjuster, causing the adjuster to move the injector to aid the injector in imparting said counteracting acceleration on the coiled tubing.

18. The method of claim 17, wherein the at least one measurement device measures the heave induced acceleration of the injector in a first direction and in a second direction, which is perpendicular to the first direction.

19. The method of claim 18, wherein the counteracting acceleration on the coiled tubing is equal to and oppositely directed from the heave induced acceleration experienced by the injector.

20. The method of claim 17, wherein the at least one measurement device measures the heave induced acceleration of the injector in a first direction; in a second direction, which is perpendicular to the first direction; and in a third direction, which is along a longitudinal axis of the injector.

* * * * *